US006000735A

United States Patent [19]

Jourdenais

[11] Patent Number: 6,000,735

[45] Date of Patent: Dec. 14, 1999

[54] AUTOMATIC CHILD-RESISTANT SLIDING DOOR LOCK

[75] Inventor: Steven M. Jourdenais, Tampa, Fla.

[73] Assignee: Jormac Products, Inc., Clearwater, Fla.

[21] Appl. No.: 09/187,253

[22] Filed: Nov. 6, 1998

[51] Int. Cl.[6] ..... E05C 3/04

[52] U.S. Cl. ..... 292/238; 292/DIG. 46; 292/251.5; 70/276; 49/449

[58] Field of Search ..... 292/194, DIG. 46, 292/230, 251.5, 238, 231, 228, 136, 132, 131; 70/276, 413, 89, 90; 49/449

[56] References Cited

U.S. PATENT DOCUMENTS

| | | | |
|---|---|---|---|
| 692,463 | 2/1902 | Livingston | 49/449 |
| 1,388,272 | 8/1921 | Lawrence | 292/DIG. 46 |
| 1,463,866 | 8/1923 | Bourbeau | 292/238 |
| 1,646,181 | 10/1927 | Babekuhl | 292/DIG. 46 |
| 1,695,872 | 12/1928 | White, Jr. | 292/DIG. 28 |
| 1,724,637 | 8/1929 | Bergstrom | 292/238 |
| 2,855,772 | 10/1958 | Hillgren | 292/DIG. 46 |
| 2,920,914 | 1/1960 | Jenkins | 292/DIG. 46 |
| 2,941,832 | 6/1960 | Grossman | 292/DIG. 46 |
| 3,059,952 | 10/1962 | Wittman et al. | 292/288 |
| 3,267,613 | 8/1966 | McQuiston | 49/449 |
| 3,352,586 | 11/1967 | Hakanson | 292/227 |
| 3,744,833 | 7/1973 | Berducone | 292/251.5 |
| 3,782,147 | 1/1974 | Hallmann | 70/276 |
| 3,837,693 | 9/1974 | Adiches | 292/207 |
| 3,927,906 | 12/1975 | Mieras | 292/262 |
| 4,054,308 | 10/1977 | Prohaska | 292/204 |
| 4,061,372 | 12/1977 | Cardoso | 292/207 |
| 4,208,841 | 6/1980 | Starks | 49/449 |
| 4,460,222 | 7/1984 | Larking | 312/286 |
| 4,507,894 | 4/1985 | Anderson | 49/449 |
| 4,848,812 | 7/1989 | Slaughter | 292/144 |
| 4,919,464 | 4/1990 | Richards | 292/251.5 |
| 5,076,623 | 12/1991 | Richards | 292/251.5 |
| 5,099,663 | 3/1992 | Dearstine | 70/77 |
| 5,188,405 | 2/1993 | Maccaferri | 292/204 |
| 5,485,733 | 1/1996 | Hoffman | 70/276 |
| 5,542,721 | 8/1996 | Allen | 292/194 |
| 5,662,363 | 9/1997 | Gandhi | 292/230 |

OTHER PUBLICATIONS

Lock Haven Locksmiths, Product Catalog, BurglaBar sliding glass door and window lock, 1997.

*Primary Examiner*—Darnell M. Boucher
*Assistant Examiner*—Clifford B Vaterlaus
*Attorney, Agent, or Firm*—Larson & Larson, P.A.; James E. Larson

[57] ABSTRACT

A magnetically actuated safety lock device provides automatic locking capability to doors such as sliding glass patio doors and prevents unsupervised opening of the door by young children, thereby barring their access to dangerous environments. When the sliding door is closed, it is automatically locked. The lock device is installed in a position high upon the sliding door to prevent actuation by young children and requires no permanent modification to the door on which it is installed. The lock device consists of a locking assembly and a magnetic key. The locking assembly includes a magnetized latch assembly and a mounting bracket. The latch is held in the locked position by gravity and is only rotated into the unlocked position through the application of hand pressure or the repulsive force of the magnetic key. The doors can be unlocked from both inside and outside the door. Upon removal of either the magnetic force or hand pressure, the latch rotates back into the locked position. The latch is designed with an angled surface on one side such that as the user closes the door behind him, the door can close normally. This angled surface in the latch allows the door to slide along its track in the closing direction and, as the door edge touches the latch at the angled surface, the latch is rotated by the door into the unlocked position. Once the frame of the door slides completely past the latch, the latch rotates back into the locked position.

13 Claims, 6 Drawing Sheets

AUTOMATIC CHILD-RESISTANT SLIDING DOOR LOCK

BACKGROUND OF THE INVENTION

This invention relates to child-resistant door locks. More particularly, it refers to a magnetically controlled means for opening automatic door locking mechanisms.

A variety of locking mechanisms exist for use in conjunction with sliding doors such as glass patio doors. These devices include bars, pins, track-mounted stops and latch-keeper devices. The bar-type locking mechanism prevents the door from sliding by spanning the distance between the edge of the door and the door jamb, thereby reacting to a door opening force in compression. Pins prevent the door from sliding by pinning the door to a stationary member such as the door frame of the opposite door, thereby reacting to a door opening force in shear. Track-mounted stops are secured to the track on which the sliding door glides and block the door from sliding along the track once the door engages the stop. Finally, latch-keeper combinations consist of a latch in the door frame and a keeper in the door jamb which engage together to secure the door frame to the door jamb.

In the case of bar-type, pin-type and track-mounted stop configurations, it is not possible to lock or unlock the door from the face of the door opposite the face on which the pin-type, bar-type or track-mounted stop is installed. In the case of latch-keeper mechanisms, the locking and unlocking means is normally found at an elevation accessible to small children and these mechanisms are not normally constructed to prevent unlocking from the interior of the building in which the door is installed. In more sophisticated versions of these types of mechanisms, key actuated latch-keeper lock mechanisms may be employed. This type of lock mechanism is expensive, is difficult to add to pre-existing door installations, and requires permanent modifications to the door. Pin-type and bar-type locking devices also require permanent door modifications to doors on which they are installed.

The present invention is intended to overcome the deficiencies of the prior art. The door lock of this invention can be easily installed by the door owner without the use of tools and requires no permanent modification to the door on which it is installed. The door lock of this invention may be removed easily from the door when there is no more need for it. On the side of the door on which the inventive locking device is installed, it can be opened by anyone able to reach to the elevation of the device as installed. On the opposite face of the door, typically outside the building in which the door is installed, the user grasps a magnetic key stored at a high elevation near that door face and places the key against the outer surface of the door, thereby causing the latch to rotate into the unlocked position as will be described in greater detail hereinafter.

The following prior art is known to Applicant:

U.S. Pat. No. 4,848,812 to Slaughter discloses a concealed safety lock having a bolt in the form of a cylindrical magnet that may be moved through the use of a magnetic key.

U.S. Pat. Nos. 4,919,464 and 5,076,623, both to Richards, disclose latch mechanisms for use, for example, in holding a door leaf closed and include a pivotable assembly carrying a magnet that holds a magnetically attractive material attached to the door leaf closely adjacent thereto in one position thereof, and is pivoted away from that position responsive to close proximity of a magnetic key, thereby allowing the door leaf to be opened.

U.S. Pat. No. 5,188,405 to Maccaferri discloses a locking device for a latch similar to that of the Richards patents but including the further provision of a locking mechanism designed to hold the latch in an open position.

U.S. Pat. No. 5,485,733 to Hoffman discloses a concealed magnetic lock for cabinet closure that includes a pivotable magnetic piece biased in one direction through a built-in magnet and pivotable away from that position through the use of a magnetic key.

The present invention differs from the teachings of these patents as contemplating a latch designed to move and lock through the force of gravity to a latched position automatically and may be moved to an unlatched position through the repelling force between a latch-mounted magnet and a magnet mounted in a key.

SUMMARY OF THE INVENTION

The present invention relates to an automatic child-resistant sliding door lock. The present invention includes the following interrelated objects, aspects and features:

(1) In a first aspect, the present invention is intended to be easily installed by the door owner on an existing sliding door such as a set of glass patio doors. The inventive lock is intended to be mounted on the door through the use of adhesive and may be removed subsequently when appropriate, without causing any cosmetic damage to the door.

(2) The inventive lock includes a latch pivotably mounted on a bracket with the pivot point and latch geometry being so chosen that the latch tends to rotate in one desired direction of rotation. An angled lower surface is provided in which a magnet is embedded with this angled surface pressing flat against a portion of the bracket immediately adjacent to and parallel with the door surface in the latched position thereof.

(3) In the latched position of the latch, an upper corner thereof extends outwardly to a position interfering with sliding movements of the door, thereby preventing such movements.

(4) Adjacent the upper surface, an upper angled surface is provided for an important purpose. When the latch has been moved to a position allowing the door to slide toward the open position, after the latch passes the frame of the fixed piece of glass forming the other half of a glass patio door system, the user's fingers may no longer engage the latch and, through force of gravity, it pivots to the normally latched position. Without the upper angled surface, when one would subsequently move the door toward the closed position, the latch would be captured on a side of the frame of the fixed piece of glass remote from the location corresponding to complete closure of the sliding glass door. When the angled surface engages the frame of the fixed piece of glass, further movement causes the latch to pivot to a position allowing it to slide past that frame to the closed position of the door, and when the latch clears that frame, it automatically pivots to an interfering position with respect to that frame, thereby preventing renewed opening of the door without pivoting of the latch.

(5) A key is provided that permits opening of the latch from a location outside the building where the latch is mounted. The key includes a gripping portion and a permanent magnet embedded therein with its poles arranged so that the key provides a repelling force with respect to the orientation of the permanent magnet embedded in the lower angled surface of the latch. In this way, when the key is engaged on the door surface, for example, the glass surface adjacent where the latch is mounted, the repelling force of the magnet embedded therein repels the magnet on the lower angled surface of the latch, thereby causing the latch to pivot to a position wherein the upper corner thereof no longer interferes with sliding movements of the door, whereby, the door can be re-opened.

(6) Once the door has been slid open, the key may be removed from adjacent the latch and may be restored to its storage location, preferably, a "key-keeper" mounted on an outside wall of the building at an elevation high enough so that it may not be reached by small children.

As such, it is a first object of the present invention to provide an automatic child-proof sliding door lock.

It is a further object of the present invention to provide such a door lock that automatically pivots through the force of gravity to a latched position and that may be pivoted from that latched position through application of the repelling force of a magnetic key.

It is a yet further object of the present invention to provide such a door lock including an upper angled surface situated to prevent the latch thereof from being captured on the other side of an adjacent frame of a fixed portion of the building structure when the door is being slid toward a closed position.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
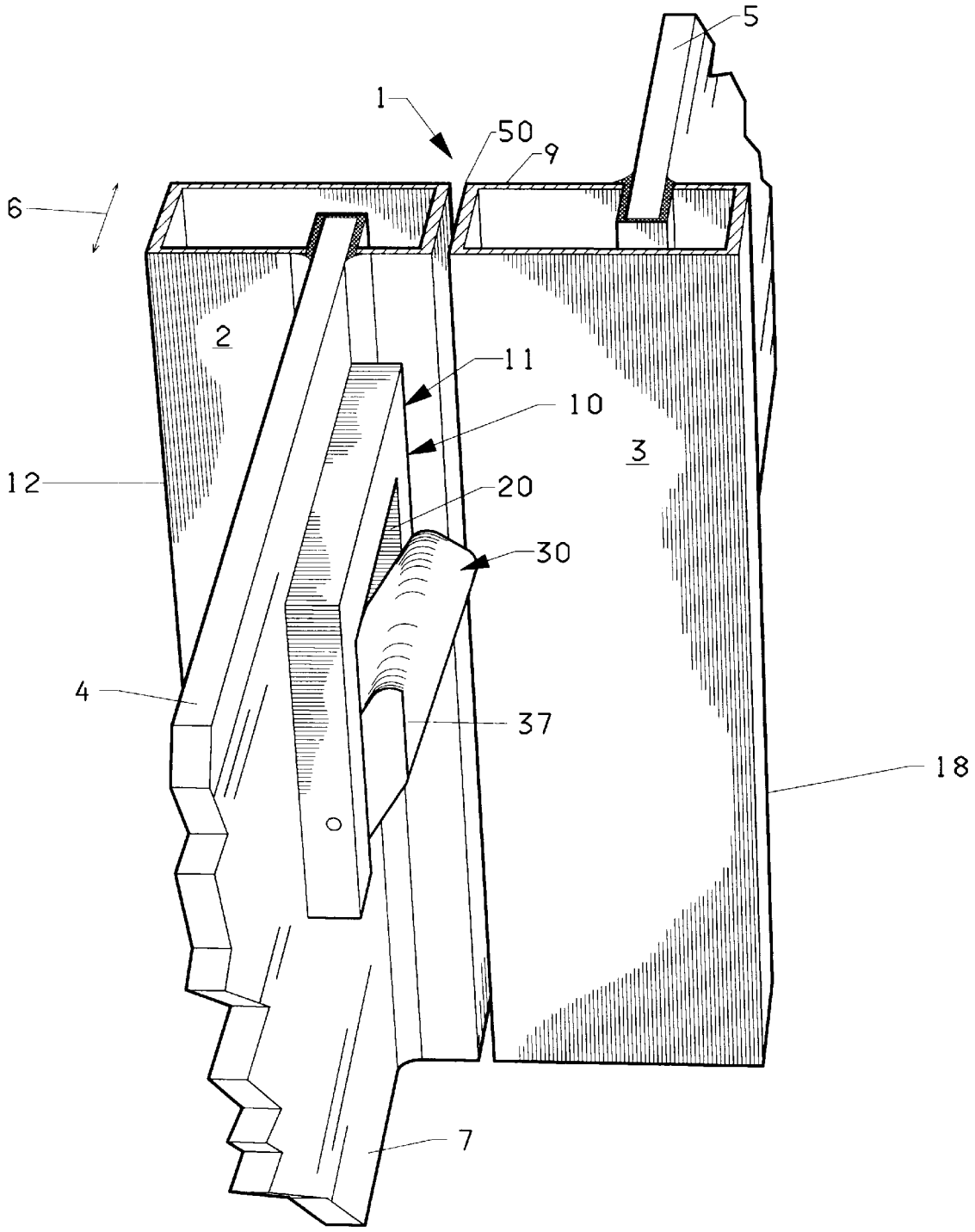
FIG. 1 shows a perspective view of a sliding glass door having the inventive lock installed thereon.
Figure 6:
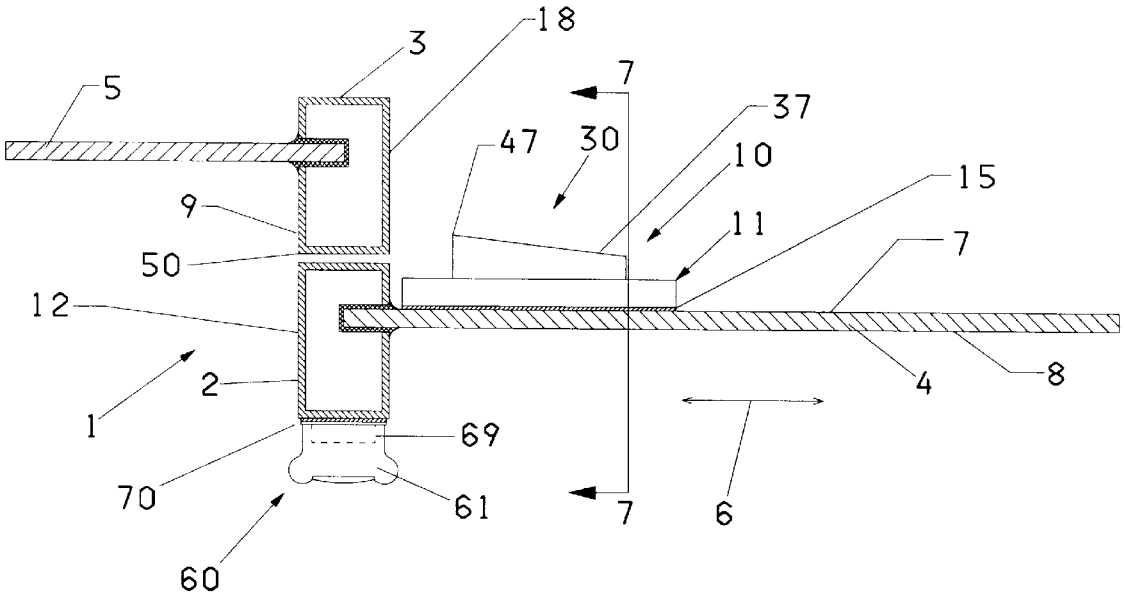
FIG. 6 shows a top view of the door lock in the locked position with the associated door shown partially in cross-section.

With reference, first, to FIGS. 1 and 6, a typical door on which the inventive door lock may be applied is generally designated by the reference numeral 1 and is seen to include a first frame 2 and a second frame 3, with the first frame 2 enclosing a piece of glass 4 and with the second frame 3 enclosing a piece of glass 5. The frame 2 and the piece of glass 4, together, comprise a sliding glass door 12 guided by a track (not shown) in sliding movements with respect to the frame 3. Piece of glass 5 is included in sliding glass door 18. Door 18 remains stationary with respect to door 12. The double-headed arrow 6 depicts the directions of sliding of the sliding glass door 12. Viewing of FIGS. 6 and 8, the side 7 of the piece of glass 4 is inside the building (not shown) in which the door assembly 1 is mounted while the side 8 of the piece of glass 4 is outside that building.

Figure 7:
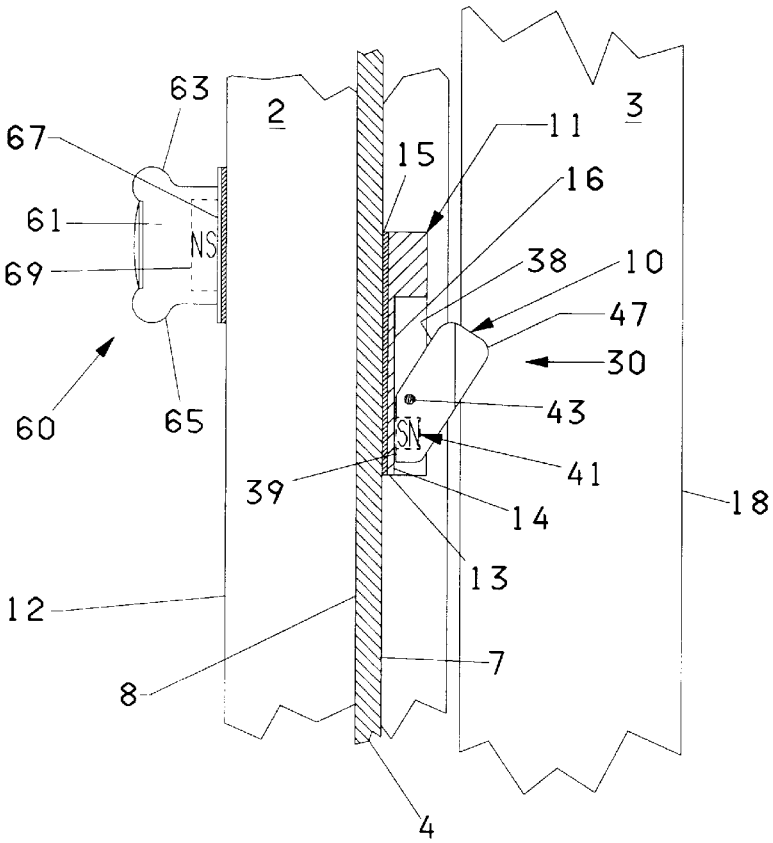
FIG. 7 shows a side sectional view along line 7—7 of FIG. 6 with the latch in the locked position.
Figure 9:
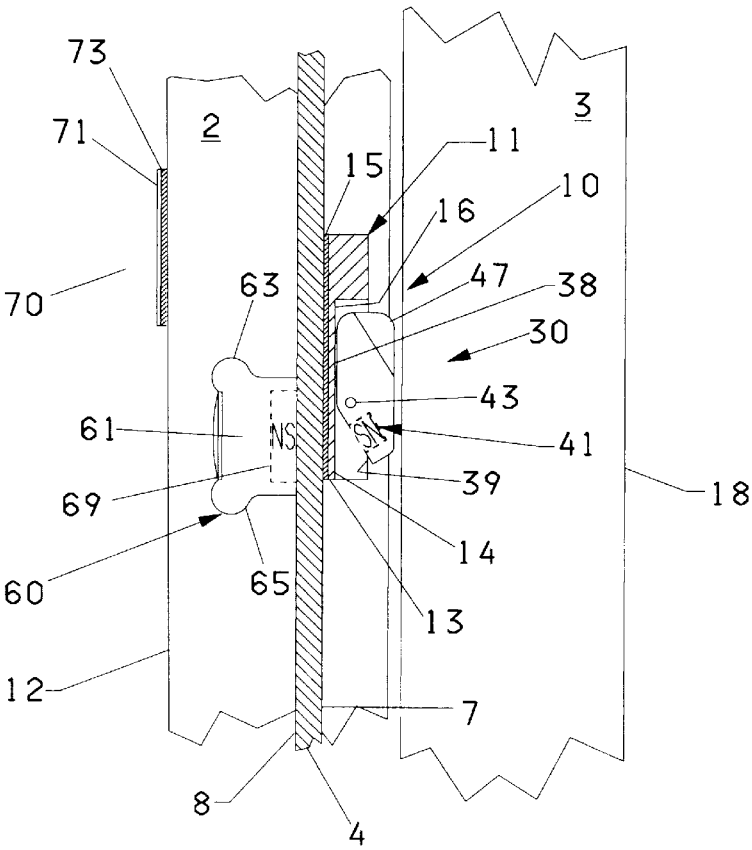
FIG. 9 shows a sectional view along line 9—9 of FIG. 8, with the latch in the unlocked position and with the associated door shown partially in cross-section.

With reference to the figures, the present invention is generally designated by the reference numeral 10 and includes a bracket 11 as well as a pivotably mounted latch 30. With reference, in particular, to FIGS. 7 and 9, the bracket 11 includes a thin, rear wall 13 affixed to the surface 7 of the piece of glass 4 by a suitable adhesive layer 15.

Figure 4:
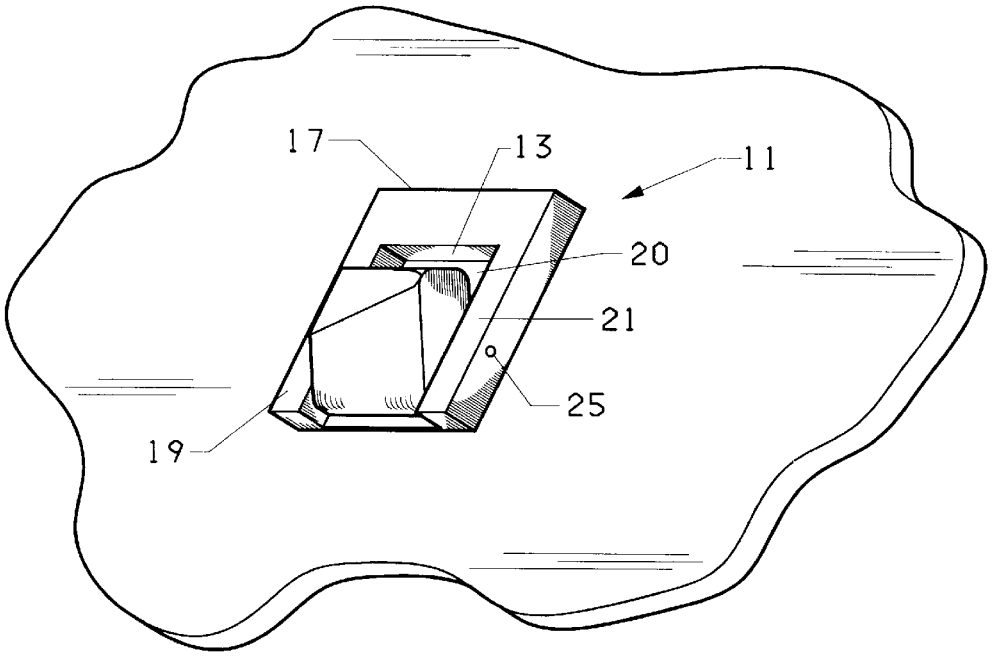
FIG. 4 shows a perspective view of the inventive door lock in the locked position viewed from an opposite end of the latch as shown in FIG. 1.
Figure 5:
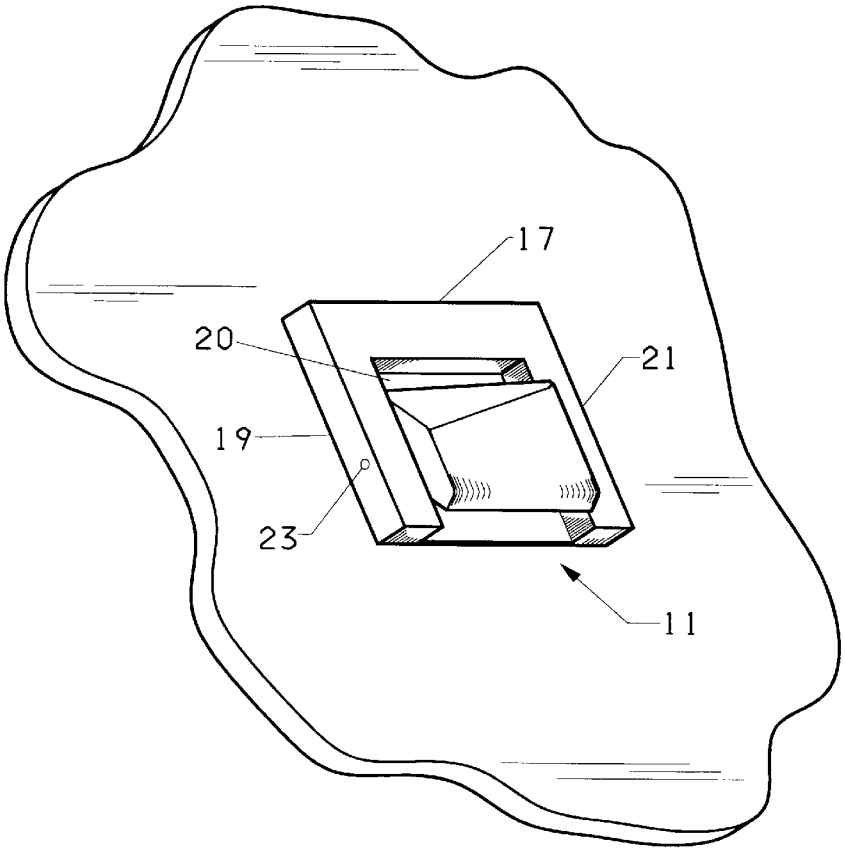
FIG. 5 shows an opposite end perspective view of the lock assembly to that of FIG. 4, but with the latch in the unlocked position.

With particular reference to FIGS. 4 and 5, the bracket 11 has a portion of generally inverted U-shaped configuration including a horizontal portion 17 and vertically depending legs 19 and 21. The legs 19 and 21 have respective holes 23 and 25 therethrough that are axially aligned with one another and are provided for a purpose to be described in greater detail hereinafter.

Figure 2:
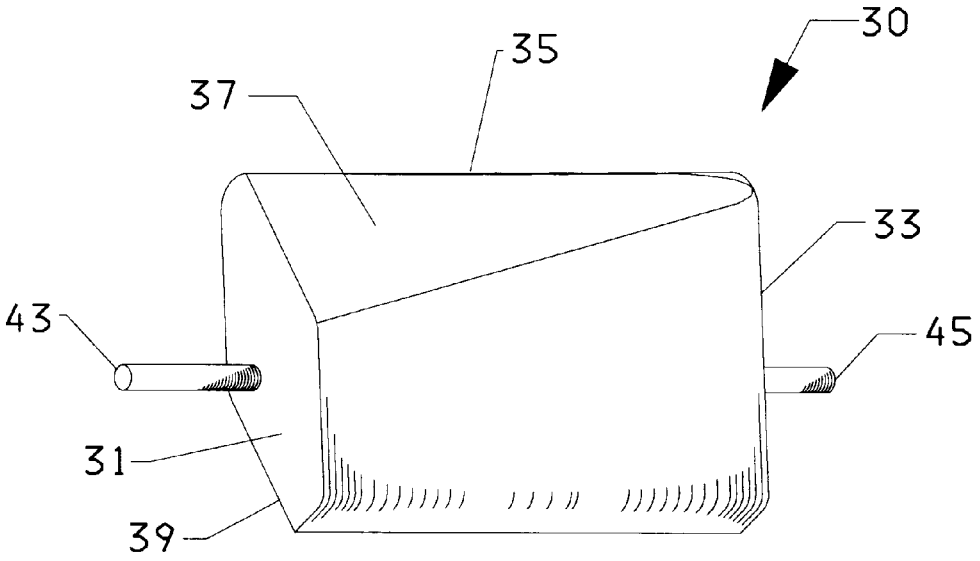
FIG. 2 shows a front perspective view of the latch of the inventive door lock.
Figure 3:
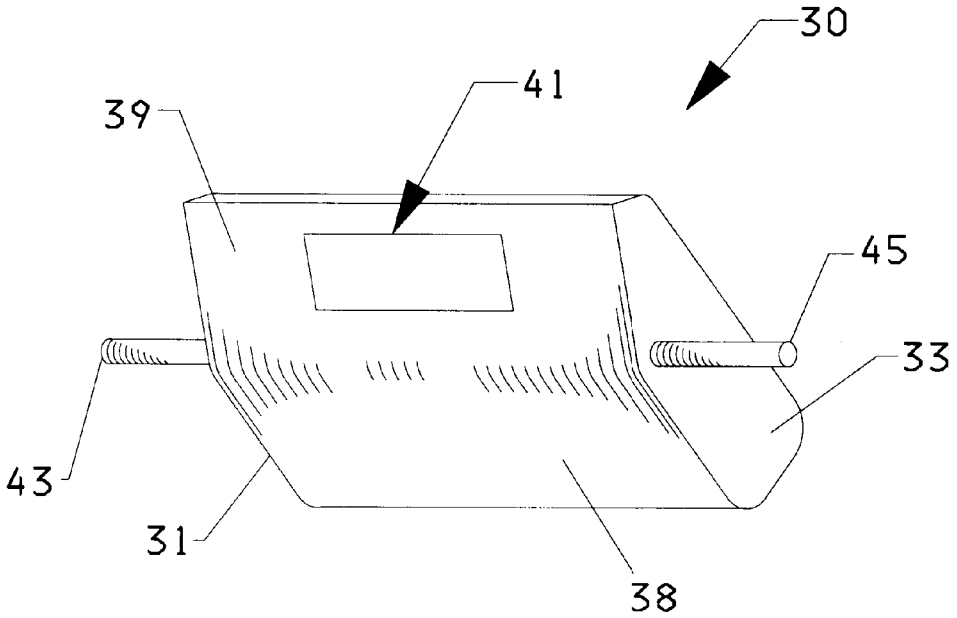
FIG. 3 shows a rear perspective view of the latch of the inventive door lock, inverted with respect to the orientation of FIG. 2, to show details of the embedded magnet.

With reference to FIGS. 2 and 3, the latch 30 includes side walls 31 and 33. With reference to FIG. 2, an upper edge 35 and an upper angled surface 37 are provided for a purpose to be described in greater detail hereinafter.

As seen in FIGS. 3, 7, and 9, the latch 30 also includes a lower angled surface 39 on a lower half thereof in which is embedded a permanent magnet 41 having its poles arranged in the orientation shown in FIGS. 7 and 9. The latch 30 also includes an upper angled surface 38 on the upper half thereof. The lower angled surface 37 and the upper angled surface 38 are provided for a purpose to be described in greater detail hereafter.

With reference to FIGS. 2 and 3, a pin 43 extends outwardly perpendicular to the sidewall surface 31 while a pin 45 extends outwardly perpendicularly to the sidewall surface 33 with the pins 43 and 45 being axially aligned with one another. The surface 37 extends obliquely with respect to the axis of alignment of the pins. As should be understood from comparing FIGS. 2 and 3 and FIGS. 4 and 5, the pin 43 is received within the opening 23 of the bracket 11 while the pin 45 is received within the opening 25 of the bracket 11. The dimensions of the pins 43 and 45 is such that the latch 30 freely pivots within the opening 20 defined between the legs 19 and 21 and the horizontal portion 17.

With reference to FIG. 7, the pins 43 and 45 (not shown in this view) are so located on the latch 30 that the weight distribution thereof, also taking into account the location of the magnet 41, causes the latch 30 to tend to freely pivot to the orientation shown in FIG. 7 with lower angled surface 39 thereof engaging the lower surface 14 of the thin, rear wall 13 of the bracket 11 that acts as a limit stop limiting the rotation in the clockwise direction in the view of FIG. 7 to the position shown. In that position, the corner 47 of the latch 30 protrudes into a space aligned with the frame 3 such that movement of the door 12 or the opposite door 18 in the opening direction thereof is prevented by engagement of the corner 47 and the adjacent structure of the latch 30 with the frame 3.

As should clearly be understood from FIG. 9, the latch 30 may be moved to a different position (shown in FIG. 9) wherein the corner 47 thereof no longer protrudes into a space aligned with the frame 3. In the position shown in FIG. 9, the sliding door 12 or the opposite door 18 may freely slide to the open position of the door assembly 10. To prevent over rotation of the latch 30, the upper angled surface 38 engages the upper surface 16 of the thin rear wall 13 of the bracket 11.

Figure 8:
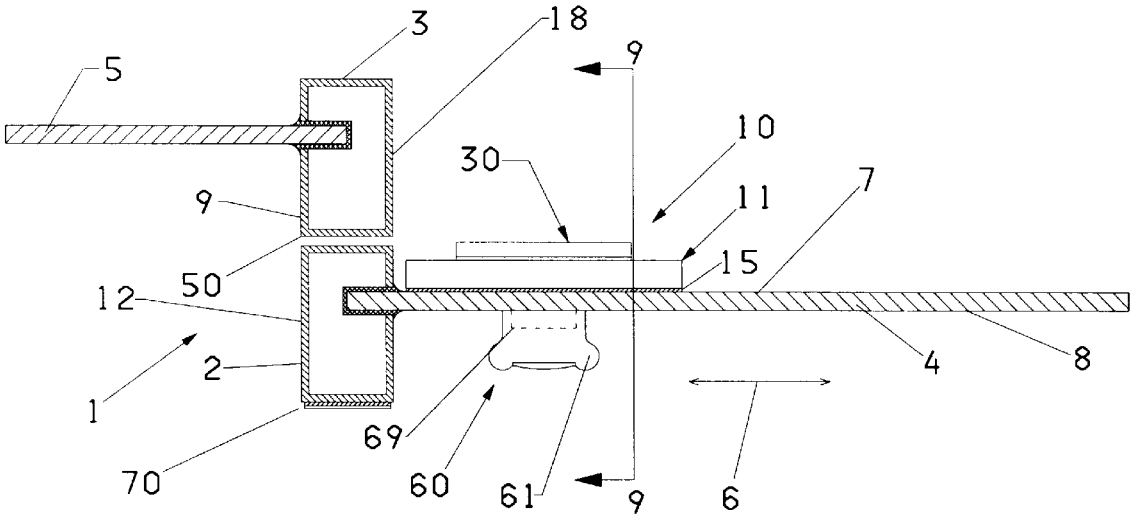
FIG. 8 shows a top view of the door lock in the unlocked position and with the associated door shown partially in cross-section.

As best understood from FIG. 6 and 8, one may manually pivot the latch 30 to the position shown in FIG. 9 whereupon the door 12 may be moved linearly on its track (not shown) in the left-hand direction in the view of FIG. 6 and 8, to an open position. During the opening process, the latch 30 will move to the left of the frame 3. Once the latch 30 is completely to the left of the frame 3, through force of gravity, the latch 30 will naturally swing back to the position shown in FIG. 7 whereupon the corner 47 protrudes into the space aligned with the frame 3 but, in this case, closer to the glass 5. Thus, from that position, when it is desired to move the frame 2 in the opposite direction to close the door 1, without the upper angled surface 37, the latch 30 would engage the inside surface 9 (FIG. 6) of the frame 3, thereby preventing complete closure of the sliding door portion 12. However, in light of the inclusion of the upper angled surface 37, when the latch 30 engages the frame 3, in fact, the surface 37 thereof engages the corner 50 of the frame 3 with further movement pivoting the latch 30 from the orientation shown in FIG. 9 to the orientation shown in FIG. 7 to allow the latch 30 to move past the frame 3 whereupon, through force of gravity, its orientation is restored to the position shown in FIG. 7.

When the user is outside the building (not shown), in which the door assembly 1 is mounted, and the latch assembly 10 is in the locked configuration shown in FIG. 7, thereby precluding opening of the door assembly 1, the present invention also includes a key 60 that may be employed to open the latch assembly 10.

In this regard, reference is made to FIGS. 7 and 9 that show a key 60 including a body 61 with surfaces 63 and 65, facilitating gripping of the key 60 with the fingers of the user. The key includes a forward surface 67 in which is embedded a permanent magnet 69 having poles oriented in a manner such that with the latch 30 in the orientation depicted in FIG. 7, the magnetic force of like poles between the magnets 41 and 69 will repel one another when the key 60 is placed in the position shown in FIG. 9, thereby causing the latch 30 to move to the position shown in FIG. 9, whereupon the door 12 may be slid to the open position. When the key 60 is removed from the surface 8 of the piece of glass 4, its magnet 69 is no longer close enough to the magnet 41 of the latch 30 to have any effect thereon, therefore, the latch 30 moves through force of gravity to the orientation shown in FIG. 7.

As shown in FIGS. 7 and 9, a key-keeper 70 consists of a flat, steel plate 71 affixed to the frame 2 by a strip of adhesive 73. Of course, steel is a magnetically attractive material and the key 60 will adhere to the steel plate 71 in the manner depicted in FIGS. 7 and 9. The key could be alternatively mounted permanently as a momentary switch over the magnet 41 on the opposite side of the glass.

Figure 10:
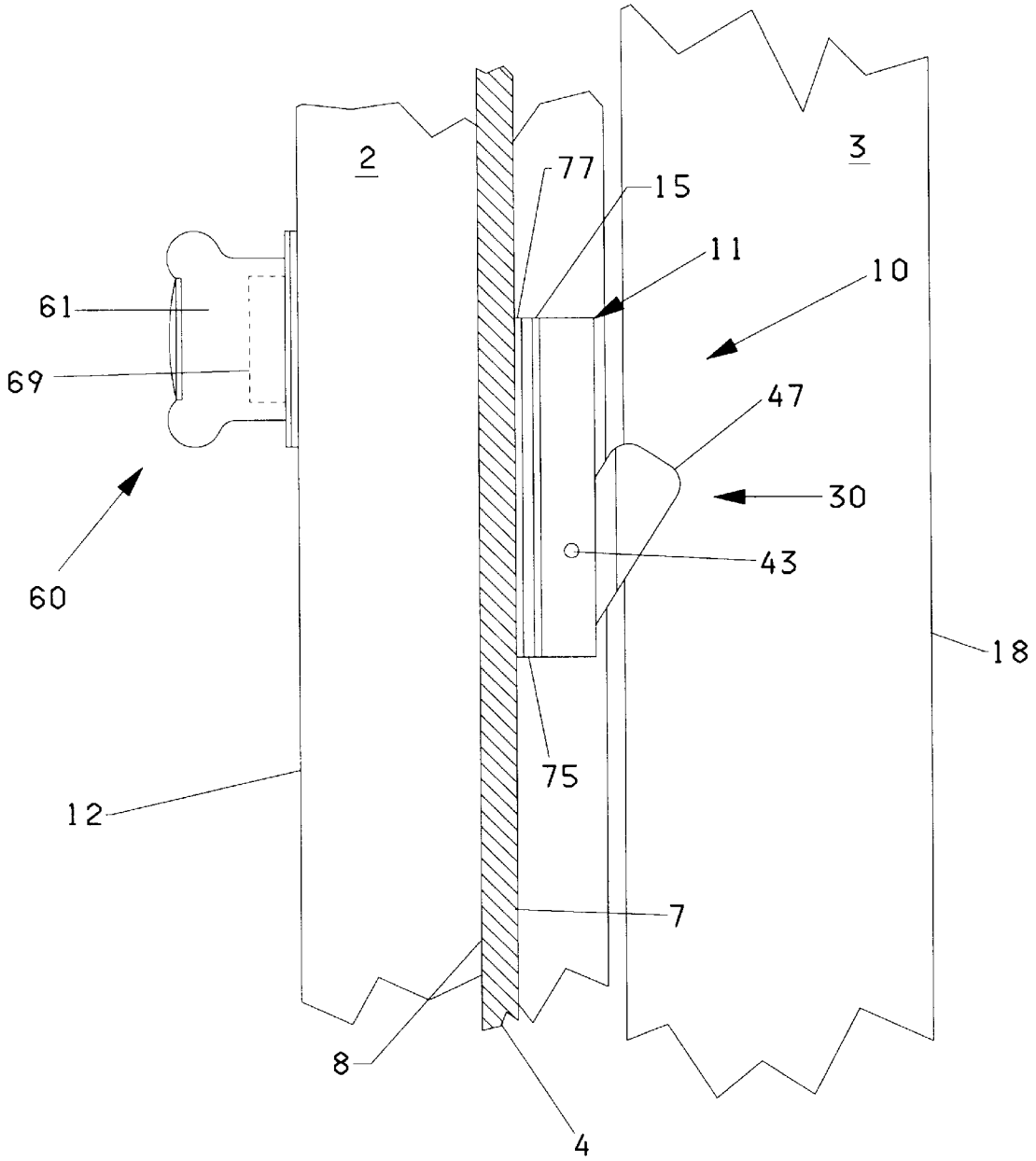
FIG. 10 shows a view similar to that of FIG. 7 but with shims being provided on the mounting bracket to cause a larger portion of the latch to protrude outwardly in the locked position thereof.

With reference to FIG. 10, a slight modification is shown wherein a shim 75 is interposed between the thin, rear wall 13 of the bracket 10 and the surface 7 of the piece of glass 4. As shown in FIG. 9, the adhesive 15 is employed to adhere the thin, rear wall 13 to the shim 75 and the shim 75 is adhered to the surface 7 of the piece of glass 4 by another adhesive layer 77. Any number of shims such as that which is depicted by the reference numeral 75 may be employed to appropriately adjust the position of the latch 30 with respect to the piece of glass 4 and the frame 3 so that in the position of the latch 30, best seen in FIG. 7, the corner 47 thereof protrudes sufficiently in the way of an area aligned with the frame 3 so that the latch 30 is operative.

In the preferred embodiment of the present invention, the pins 43 and 45 are made of a suitable non-corroding material having sufficient strength and stiffness to fully withstand loads that might be encountered when a user attempts to open the door assembly 1 without unlocking the locking device 10. In the preferred embodiment, the material of the pins 43 and 45 is stainless steel.

In the preferred embodiment, the latch 30 and shim 75 as well as the mounting bracket 11 are made of a high-impact strength and high-stiffness ABS plastic material that is ultraviolet-stable and capable of withstanding loads that might be encountered when a user attempts to open the door assembly 1 without unlocking the lock assembly 10. The bracket 11 is preferably made of a high-impact strength and high-stiffness thermoplastic that is ultraviolet-stable and opaque to provide high visibility.

In the preferred embodiment, the magnets 41 and 69 are made of a ceramic magnet material. The body of the key 60 is preferably made of a similar material to that of the bracket 11.

As such, an invention has been disclosed in terms of a preferred embodiment thereof which fulfills each and every one of the objects of the invention as set forth hereinabove and provides a new and useful automatic child-proof sliding door lock of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. In a sliding door assembly moving along a horizontal plane including a sliding door having a frame adjacent a flat surface, said sliding door being slidable past a closely adjacent vertical wall of an associated structure, the improvement comprising a lock assembly including:

a) a bracket mountable on said flat surface;

b) a latch pivotably mounted on said bracket about a pivot axis and including a lower half with a lower surface limiting a degree of pivoting of said lower half toward said flat surface, said latch pivot axis being located such that said latch is weight-biased, by force of gravity, to pivot in a direction toward engaging said lower surface with said flat surface and to rest normally in a locked position;

c) said latch including an upper corner protruding adjacent said vertical wall when said lower surface is adjacent said flat surface, whereby said corner may engage said vertical wall to prevent sliding movement of said sliding door, and wherein said latch further includes a permanent magent having a surface comprising at least a part of said lower surface.

2. The improvement of claim 1, wherein said latch has an upper angled surface extending from said corner obliquely with respect to said pivot axis, said corner being between said vertical wall and said upper angled surface when said sliding door is in a closed position.

3. The improvement of claim 1, wherein said bracket is attached to said flat surface by adhesive.

4. The improvement of claim 3, wherein said flat surface comprises a surface of a piece of glass.

5. The improvement of claim 4, wherein said vertical wall comprises a further frame surrounding a further piece of glass.

6. The improvement of claim 1, further including a key including a further permanent magnet, poles of said magnets being so arranged that moving said key adjacent said latch causes said latch to pivot said lower surface away from said flat surface.

7. The improvement of claim 6, whereby said upper corner of said latch does not protrude adjacent said vertical wall when said lower surface is pivoted away from said flat surface.

8. The improvement of claim 7, wherein said flat surface comprises a surface of a piece of glass.

9. The improvement of claim 6, wherein said key includes a key-keeper comprising a flat plate made of magnetically attractive material and mounted adjacent said door assembly.

10. In a sliding door assembly moving along a horizontal plane including a sliding door having a frame surrounding a piece of glass having a flat surface, said sliding door being slidable past a closely adjacent fixed frame having a further piece of glass therein, the improvement comprising a lock assembly including:

a) a bracket mountable on said flat surface with adhesive;

b) a latch pivotably mounted on said bracket about a pivot axis and including a lower half with a lower surface limiting a degree of pivoting of said lower half toward said flat surface, said latch having a permanent magnet having a surface comprising at least a part of said lower surface, said latch pivot axis being located such that said latch is weight-biased, by force of gravity, to pivot in a direction toward engaging said lower surface with said flat surface and to rest normally in a locked position;

c) said latch including an upper corner protruding adjacent said fixed frame when said lower surface is adjacent said flat surface, whereby said corner may engage said fixed frame to prevent sliding movement of said sliding door; and d) said latch having an upper angled surface extending from said corner obliquely with respect to said pivot axis, said corner being between said fixed frame and said upper angled surface when said sliding door is in a closed position.

11. The improvement of claim 10, further including a key including a further permanent magnet, poles of said magnets being so arranged that moving said key adjacent said latch causes said latch to pivot said lower surface away from said flat surface.

12. The improvement of claim 10, whereby said upper corner of said latch does not protrude adjacent said fixed frame when said lower surface is pivoted away from said flat surface.

13. The improvement of claim 11, wherein said key includes a key-keeper comprising a flat plate made of magnetically attractive material and mounted adjacent said door assembly.

* * * * *